US007748200B2

(12) United States Patent
Buchman

(10) Patent No.: US 7,748,200 B2
(45) Date of Patent: Jul. 6, 2010

(54) TOP-FILL, RECLOSABLE STAND-UP PACKAGE WITH SLIDER DEVICE AND TAMPER-EVIDENT STRUCTURE AND METHOD OF MANUFACTURING SAME

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 146 days.

(21) Appl. No.: 11/671,709

(22) Filed: Feb. 6, 2007

(65) Prior Publication Data

US 2007/0127850 A1 Jun. 7, 2007

Related U.S. Application Data

(62) Division of application No. 10/883,385, filed on Jun. 30, 2004, now abandoned.

(51) Int. Cl.
*B65B 61/18* (2006.01)
*B31B 1/90* (2006.01)

(52) U.S. Cl. ..... 53/412; 53/133.4; 53/139.2; 53/550; 493/214; 493/927

(58) Field of Classification Search ..... 53/412, 53/416, 133.4, 139.2, 550; 383/5, 61.2, 61.3, 383/61.5, 64, 203, 120, 204, 205; 493/213, 493/214, 237, 927
See application file for complete search history.

(56) References Cited

U.S. PATENT DOCUMENTS 3,746,215 A * 7/1973 Ausnit et al. ..... 222/92
3,935,993 A 2/1976 Doyen et al.
4,196,030 A 4/1980 Ausnit
5,063,644 A 11/1991 Herrington et al.
5,211,482 A * 5/1993 Tilman ..... 493/214
5,301,394 A 4/1994 Richardson et al.
5,456,928 A * 10/1995 Hustad et al. ..... 383/5
5,525,363 A 6/1996 Herber et al.
5,713,669 A 2/1998 Thomas et al.
5,875,611 A * 3/1999 Plourde ..... 53/412
5,906,438 A 5/1999 Laudenberg
5,956,924 A 9/1999 Thieman
6,071,011 A 6/2000 Thomas et al.
6,115,892 A 9/2000 Malin et al.
6,148,588 A 11/2000 Thomas et al.
6,264,366 B1 7/2001 Custer
6,273,607 B1 8/2001 Buchman
6,279,298 B1 8/2001 Thomas et al.
6,290,390 B1 9/2001 Buchman (Continued)

*Primary Examiner*—Louis K Huynh
(74) *Attorney, Agent, or Firm*—Merchant & Gould P.C.

(57) ABSTRACT

A reclosable, tamper-proof, fillable package includes a first side panel and a second side panel joined to each other along a pair of spaced side seals. A bottom wall extends between the first and second side panels with the bottom wall and the first and second side panels defining a package interior. A tamper-evident structure having opposite sides connected to each other extends above a combined zipper closure and slider device, and is connected to the zipper closure. Only one side of the tamper-evident structure is initially connected to one of the first and second side panels so that a fill opening adapted to receive a product is created between the other side of the tamper-evident structure and the other of the first and second side panels.

25 Claims, 14 Drawing Sheets

U.S. PATENT DOCUMENTS

| | | | | |
|---|---|---|---|---|
| 6,290,391 | B1 | 9/2001 | Buchman | |
| 6,293,896 | B1 | 9/2001 | Buchman | |
| 6,347,885 | B1 * | 2/2002 | Buchman | 383/5 |
| 6,427,421 | B1 * | 8/2002 | Belmont et al. | 53/412 |
| 6,467,956 | B1 | 10/2002 | Tilman et al. | |
| 6,499,878 | B1 | 12/2002 | Dobreski et al. | |
| 6,688,079 | B2 | 2/2004 | Kinigakis et al. | |
| 6,732,491 | B2 | 5/2004 | Buchman | |
| 6,845,598 | B1 | 1/2005 | Melchoir | |
| 6,918,234 | B2 | 7/2005 | Thomas et al. | |
| 6,939,040 | B2 * | 9/2005 | Schneider | 53/412 |
| 6,974,256 | B2 * | 12/2005 | Kinigakis et al. | 383/64 |
| 7,048,442 | B2 | 5/2006 | Schneider et al. | |
| 7,101,079 | B2 | 9/2006 | Strand et al. | |
| 7,254,873 | B2 | 8/2007 | Stolmeier et al. | |
| 7,322,920 | B2 * | 1/2008 | Johnson | 493/213 |
| 2001/0053253 | A1 * | 12/2001 | Buchman et al. | 493/213 |
| 2002/0152720 | A1 * | 10/2002 | Kinigakis et al. | 53/412 |
| 2004/0008909 | A1 | 1/2004 | Shepard et al. | |
| 2005/0157959 | A1 * | 7/2005 | Johnson | 383/61.2 |
| 2006/0228056 | A1 | 10/2006 | Ausnit | |

* cited by examiner

TOP-FILL, RECLOSABLE STAND-UP PACKAGE WITH SLIDER DEVICE AND TAMPER-EVIDENT STRUCTURE AND METHOD OF MANUFACTURING SAME

This application is a divisional of U.S. patent application Ser. No. 10/883,385, filed Jun. 30, 2004 now abandoned. application Ser. No. 10/883,385 is incorporated herein by reference.

FIELD OF THE INVENTION

The present invention relates broadly to reclosable packages, and more particularly, pertains to reclosable, stand-up packages with slider devices and tamper-evident structure manufactured utilizing form, fill and seal machines wherein the reclosable packages are top-filled.

BACKGROUND OF THE INVENTION

Form, fill and seal technology is known in the packaging industry as a method to package consumable goods. Consumable goods that are not used completely when the package is initially opened rely on a zipper closure having locking first and second profiles to reclose the package and keep the remaining contents fresh. In some applications, tamper-evident structure is included on the package to signify whether access has been gained to the package through the zipper closure. Examples of consumable goods that are often enclosed in packages with a zipper closure include potting soil, fertilizer, pet food, dog biscuits and many different foods edible by humans.

SUMMARY OF THE INVENTION

It is one object of the present invention to provide an improved method of manufacturing a top-fill, reclosable, stand-up package by inserting a tamper-evident header between a pair of side panels in a horizontal form, fill and seal process for making plastic bags.

It is also an object of the present invention to provide an improved top-fill, reclosable, stand-up package that has a combined internal and external tamper-evident structure that shields the zipper closure profiles during filling of the package being formed.

The present invention is directed to a method of manufacturing a reclosable, tamper-proof package which is filled from the top. The method includes the step of providing a tamper-evident header in the form of a web having opposite sides. A combined zipper closure and slider device is inserted between the opposite sides of the header web. The header web with the combined zipper closure and slider device is then incorporated between first and second film panels that are joined by a bottom wall.

In accordance with the method of the present invention, the header web is sealed so that the header web extends above the combined zipper closure and slider device and is connected to the zipper closure. Initially, only one side of the header web is sealed to one of the first and second film panels. The first and second film panels are then sealed to each other along a pair of spaced side seals to define a package having an open package interior. The package is filled with a product with the product passing between the other side of the header web and the other of the first and second film panels. The other side of the header web is then sealed to the other of the first and second film panels after the package has been filled with product.

In the preferred embodiment, the header web is punched and perforated and then folded into a V configuration. More particularly, the header web is formed with a series of parallel, spaced apart prior to attachment to the zipper closure longitudinal perforation lines and is formed with a plurality of aligned openings located on opposite sides of the perforation lines. The zipper closure includes first and second profile members, each including a depending attachment flange. The attachment flanges are joined to the header web at first and second seals. A first perforation line defines an area of weakness in the header web extending between the first and second seals. A top of the first film panel is connected to one midportion of the header web at a third seal. The top of the second film panel is attached to another midportion of the header web at a fourth seal. A second perforation line defines an area of weakness located above the third seal. A third perforation line defines an area of weakness located above the fourth seal. The opposite sides of the header web extending above the combined zipper closure and slider device are secured at a fifth seal. Following the step of sealing the other side of the header web to the other of the first and second film panels, the header web exposes opposite ends of the combined zipper closure and slider device.

In another aspect of the invention, a reclosable, tamper-proof, fillable package includes a first side panel and second side panel joined to each other along a pair of spaced side seals. A bottom wall extends between the first and second side panels such that the bottom wall and the first and second side panels define a package interior. A tamper-evident structure having opposite sides connected to each other extends above a combined zipper closure and slider device, and is connected to the zipper closure. Only one side of the tamper-evident structure is connected to one of the first and second side panels so that a fill opening adapted to receive a product is created between the other side of the tamper-evident structure and the other of the first and second side panels. The bottom wall includes a gusseted wall adapted to expand in response to filling of the package with the product. The other side of the tamper-evident structure is sealed to the other of the first and second side panels following filling of the package with the product. The zipper closure includes locking first and second profiles having respective first and second attachment flanges. The tamper-evident structure includes a tamper-evident membrane connected to the first and second attachment flanges. The tamper-evident structure is formed with at least one void for exposing the combined zipper closure and slider device at one end of the zipper closure.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention.

In the drawings.

DETAILED DESCRIPTION OF PREFERRED EMBODIMENTS

The addition of tamper-evident structure to a flexible, fillable package, such as a bag, is advantageous in enabling the package to be secured so that the contents will not be prematurely contaminated and, in the case of food, will be kept fresh. The process described herein installs a tamper-evident structure to bags manufactured using form, fill and seal machines which fill the bag from the top.

Figure 2:
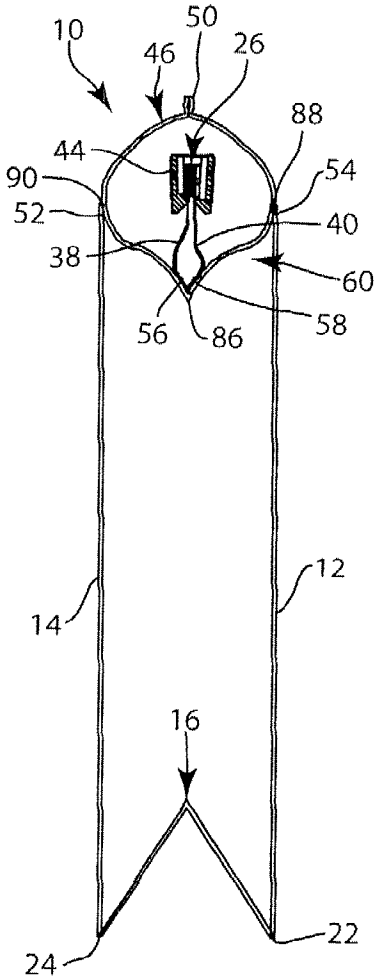
FIG. 2 is a sectional view of the package of FIG. 1.
Figure 1:
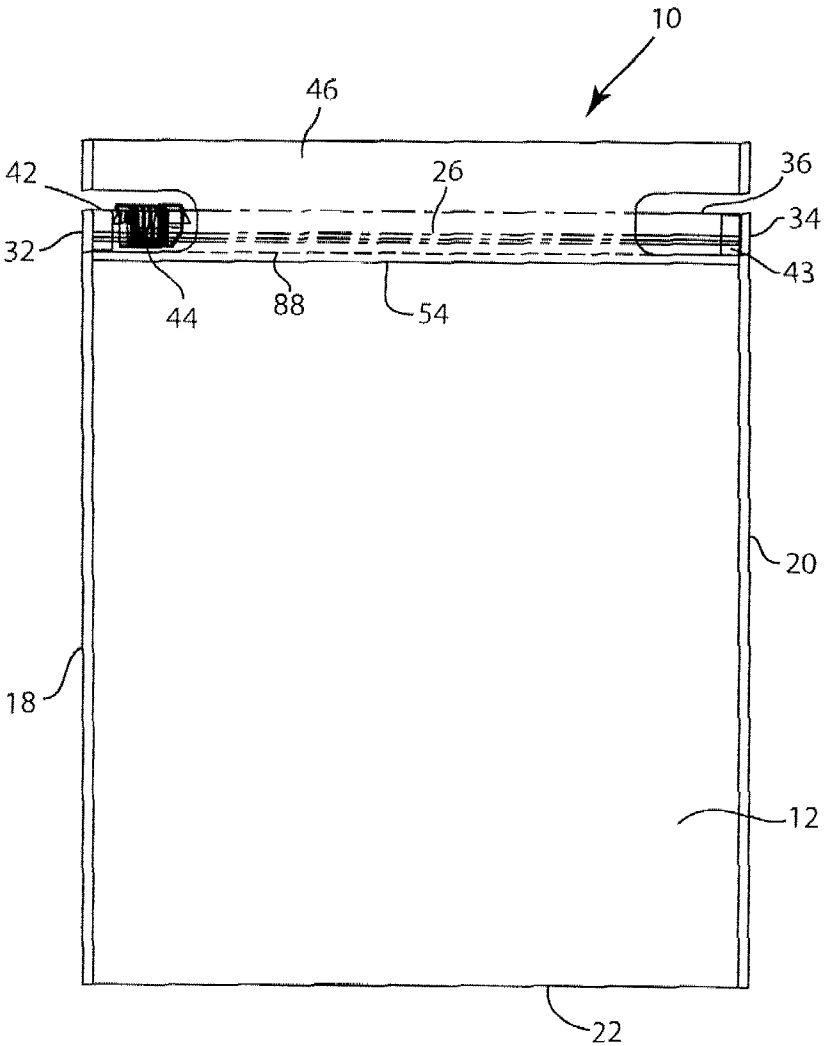
FIG. 1 is a front view of a top-fill, reclosable, stand-up package with a slider device and a tamper-evident header attached thereto.
Figure 3:
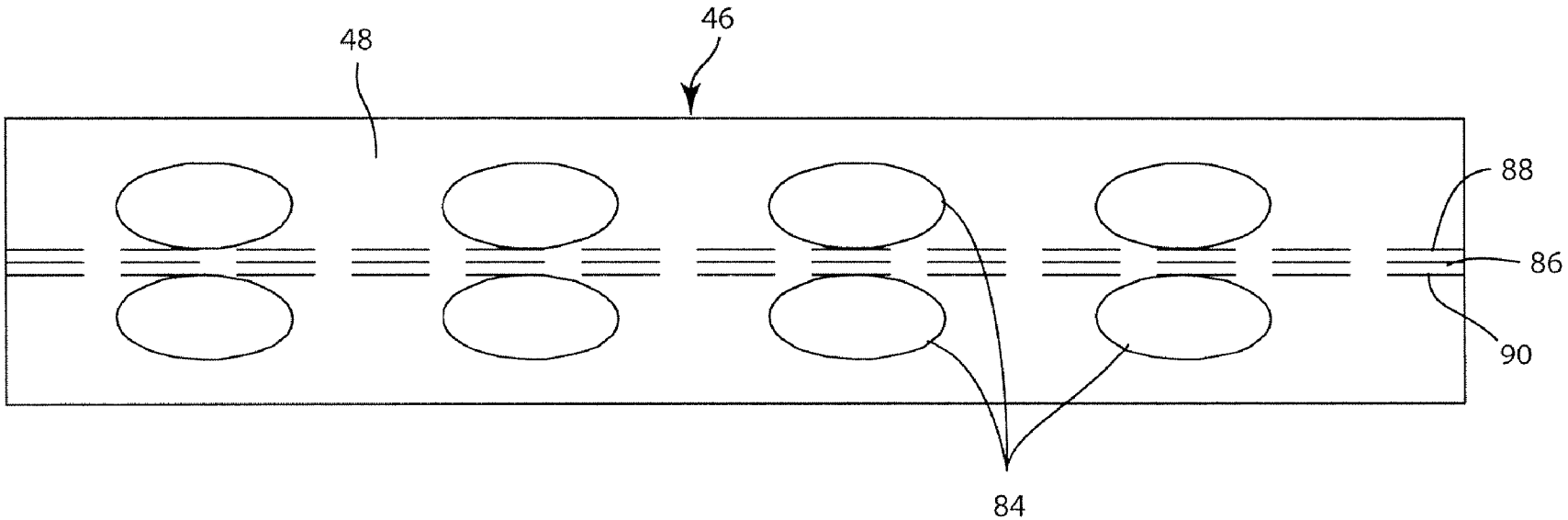
FIG. 3 is a schematic, top view of a tamper-evident header used in forming the package of FIG. 1.
Figure 5:
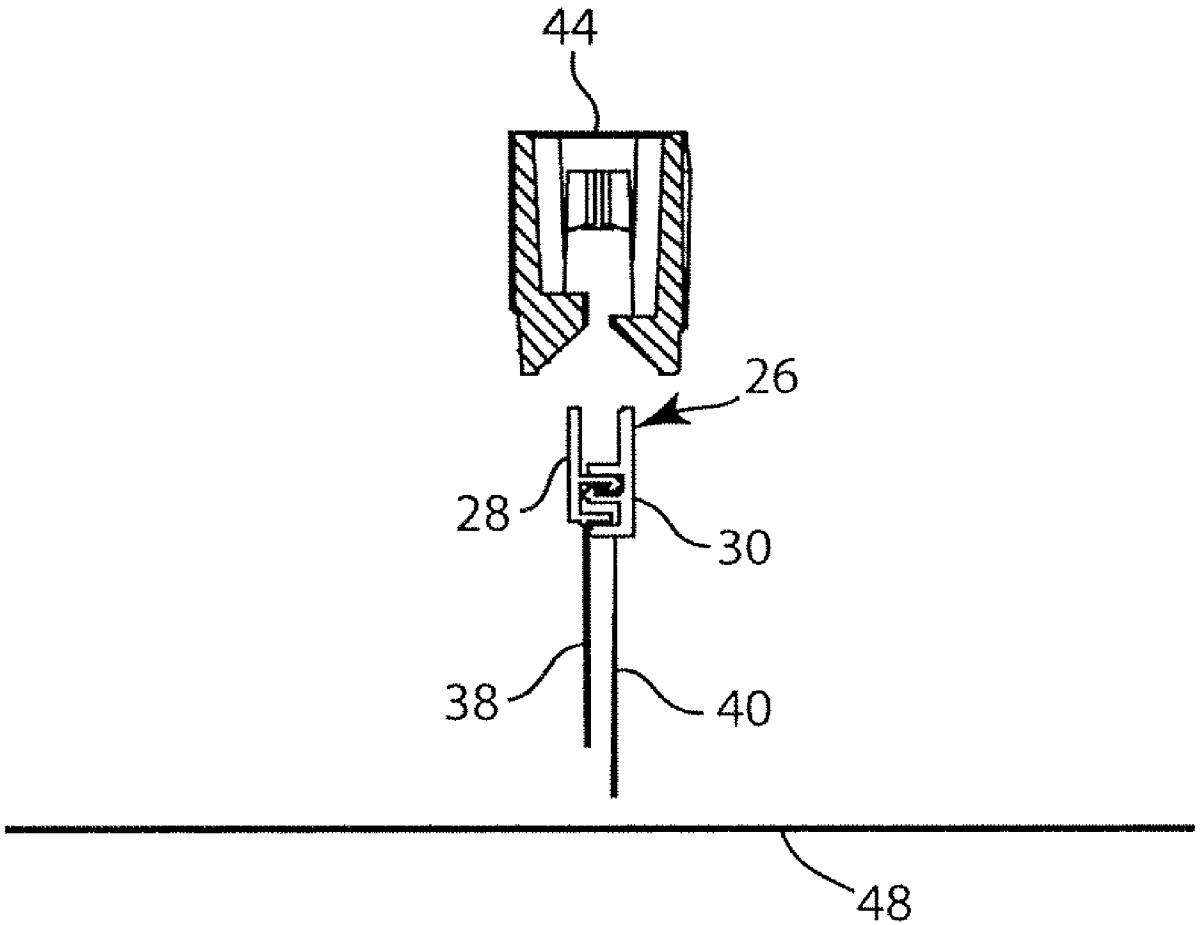
FIG. 5 is a schematic, end view of an unassembled, tamper-evident header, zipper closure and slider device used in forming the package of FIG. 1.

A flexible, reclosable package or bag 10 has side panels 12, 14 that are joined to each other by a bottom wall 16 as shown in FIGS. 1 and 2. In the embodiment shown, the bag 10 has a gusseted bottom wall 16 which allows the size of the open bag interior to increase as product is filled into the bag 10. Side panels 12, 14 are sealed together at side seams 18, 20 and sealed at lower ends with a pair of bottom edges 22, 24 on bottom wall 16. A zipper closure arrangement having mating profiles to open (unseal and reseal) the bag 10 is shown at 26. The zipper closure 26 can include a variety of configurations and structures. The zipper closure 26 includes a first mating profile 28 (FIG. 5) and a second mating profile 30 (FIG. 5) that engage and disengage, as appropriate, to open and close the bag 10. As shown in FIG. 1, the zipper closure 26 extends from a first edge 32 of the bag 10 to a second edge 34 across a mouth 36. First and second profiles 28, 30 have respective first and second flanges 38, 40 (FIG. 5) depending therefrom. Opposite ends of the zipper closure 26 are provided with end stops 42, 43 located immediately adjacent respective edges 32, 34.

A slider device 44 is mounted on zipper closure 26 to facilitate opening and closing zipper closure 26. End stops 42, 43 prevent slider device 44 from sliding off zipper closure 26 at opposite ends thereof. Slider devices and how they function to open and close zipper closures in general are taught in U.S. Pat. Nos. 5,063,644; 5,301,394 and 5,664,220, each of which is incorporated by reference herein. A notch (not shown) may be disposed within zipper closure 26 adjacent the edge 32 in the bag 10. The notch is designed to provide a "park place" into which slider device 44 settles when zipper closure 26 is sealed and slider device 44 is at the first edge 32. Such notch decreases any tendency for an incomplete interlock between first mating profile 28 and second mating profile 30.

Figure 14:
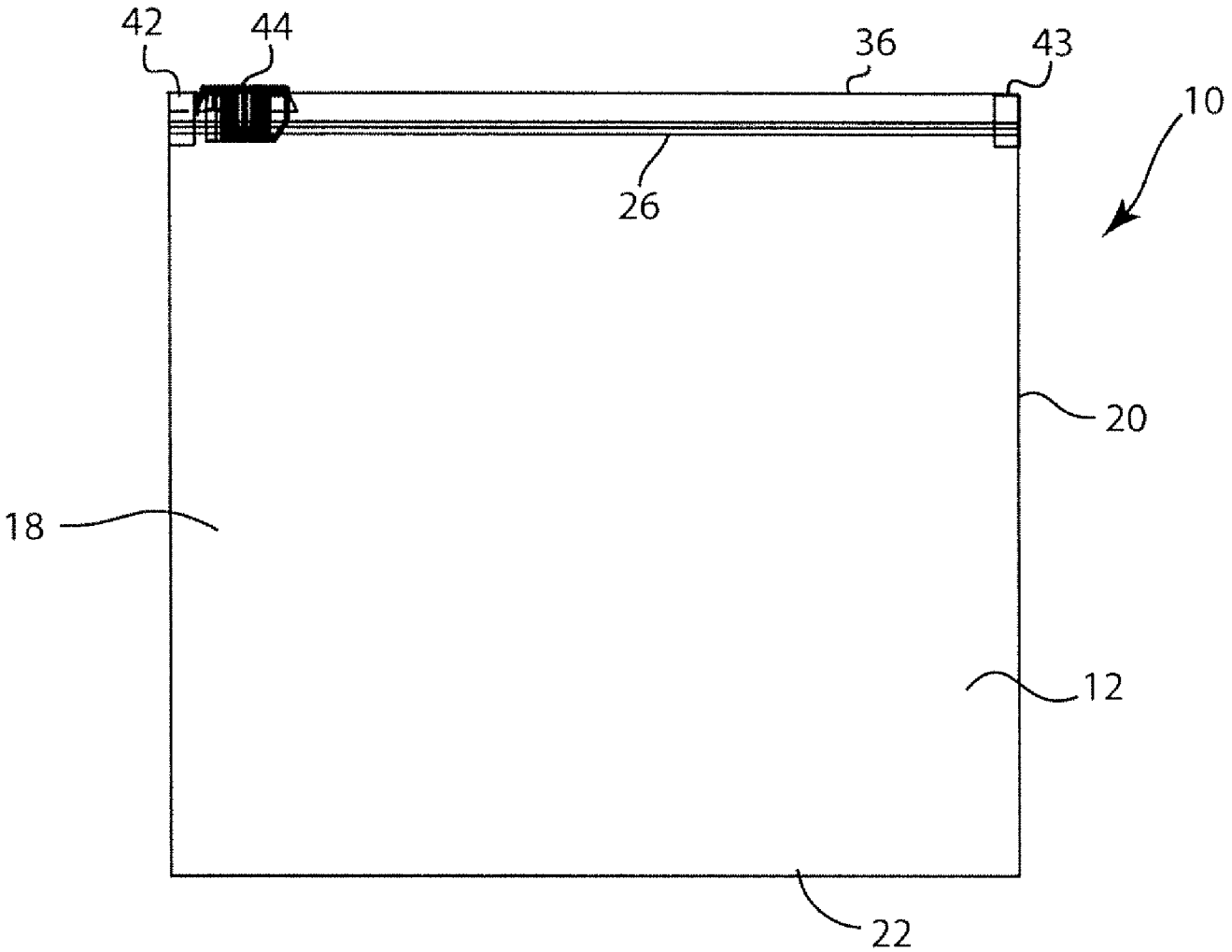
FIG. 14 is a front view of the finished, top-filled, reclosable, stand-up package with the tamper-evident header removed.

FIGS. 1 and 2 illustrate a removable or tear-off, tamper-proof or tamper-evident header 46 disposed over slider device 44. By "tamper-evident", it is meant that it provides an indication to the consumer as to whether the package 10 has been previously opened. In this embodiment, the tamper-proof header 46 covers and forms a partial enclosure around the zipper closure 26 and slider device 44 with the ends of zipper closure 26 being exposed along with the slider device 44. Tamper-evident header 46 is formed by folding a punched and perforated, elongated blank or web 48 (FIGS. 3-6) around a combined zipper closure and slider device. In the embodiment shown in FIG. 2, the tamper-evident header 46 has upper ends sealed together at 50, midportions connected to the top of the side panels 12, 14 at 52, 54 and lower portions sealed to the bottom of flanges 38, 40 of the zipper closure 26 at 56, 58. The lower portions define a tamper-evident membrane 60 connecting the flanges 38, 40. In order to access the interior of package 10 and slider device 44 for the first time, the tamper-evident header 46 needs to be removed as shown in FIG. 14. In addition, the tamper-evident membrane 60 extending between the flanges 38, 40 of the zipper closure 26 must be ruptured or removed to gain access to the interior of the bag 10.

The bag 10 described and shown in FIGS. 1 and 2 can be manufactured by a horizontal form, fill and seal machine 62 generally of the type set forth in U.S. Pat. No. 6,293,896 herein incorporated by reference. The bag 10, with the tamper-evident header 46 and the tamper-evident membrane 60, is manufactured, filled and sealed by a single process that includes sequential steps. The zipper closure 26, slider device 44 and any tamper-evident structure are partially applied to the bag prior to the bag 10 being filled with items.

Figure 12:
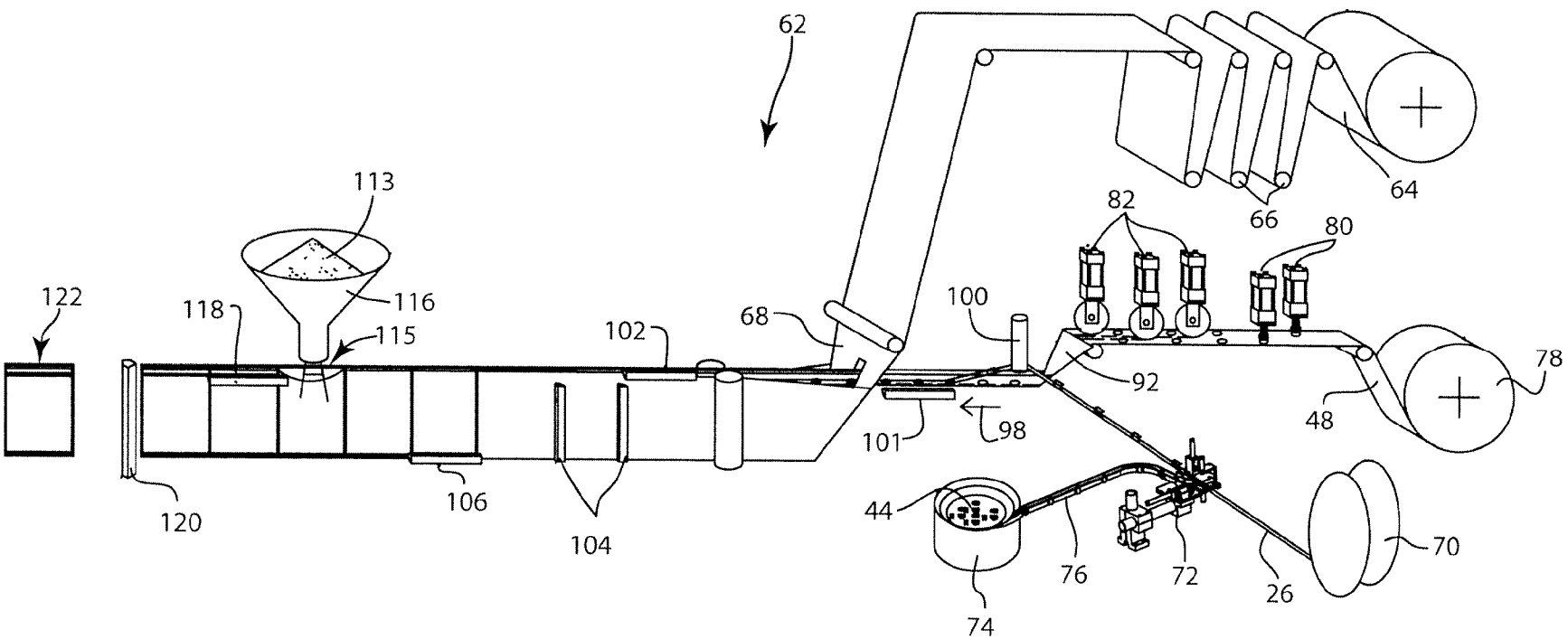
FIG. 12 is a schematic, perspective view of a horizontal form, fill and seal machine for manufacturing the top-fill, reclosable, stand-up package of FIG. 1.

Referring now to FIG. 12, the horizontal form, fill and seal machine 62 includes a process line that progresses from right to left such that the final filled bag is at the left of the Figure. The package or bag is manufactured right side up so that filling takes place through the top of the bag.

Polymeric film 64, which will provide side panels 12, 14, is supplied on a roll. A series of tensioners 66 helps to control tension on the film 64 during the bag making process. From the tensioners 66, the film 64 progresses to a V-board 68 where the film 64 is folded into side panels 12, 14 and bottom wall 16.

Figure 13:
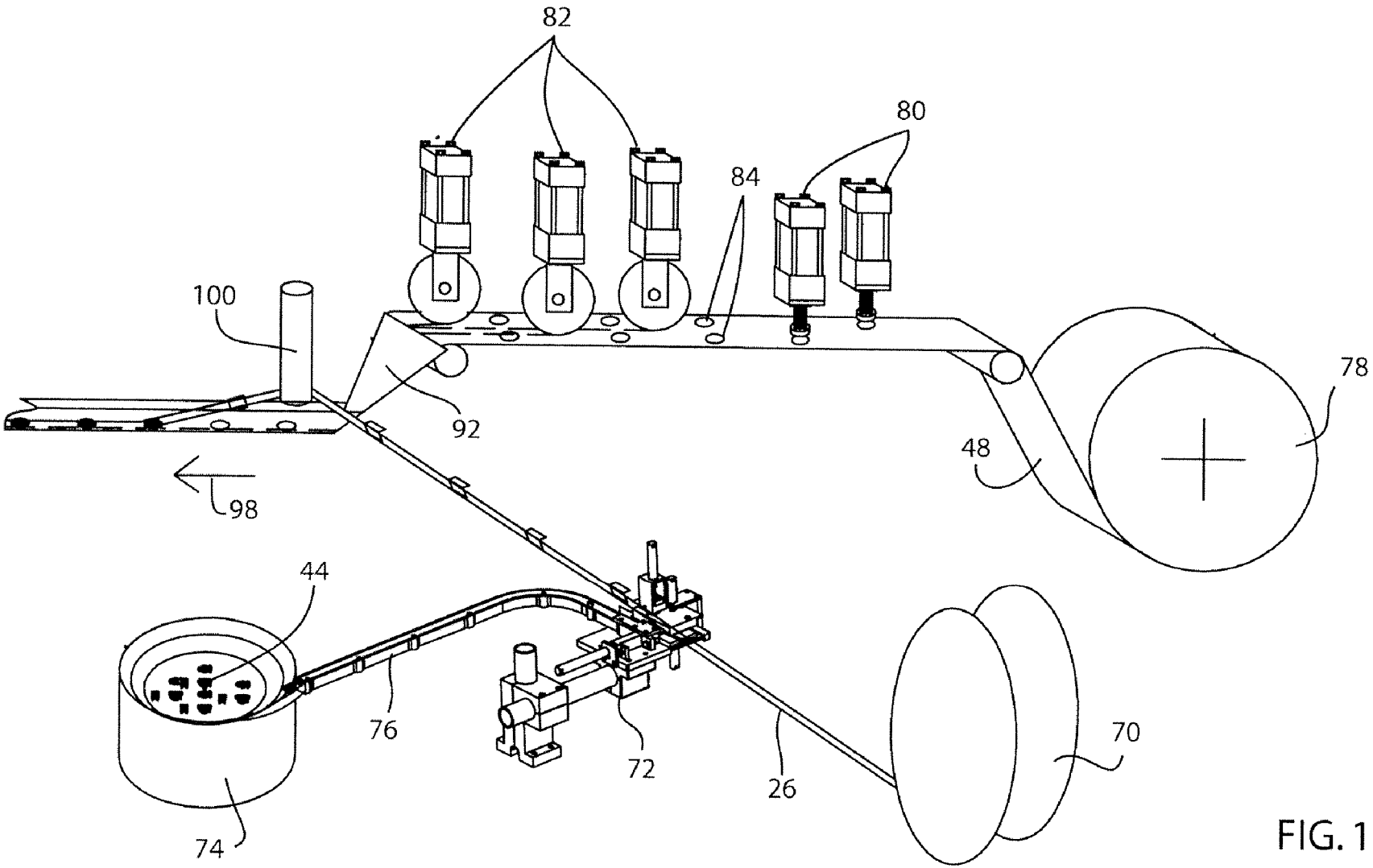
FIG. 13 is a schematic, perspective, enlarged view of a portion of the machine shown in FIG. 12.

As seen best in FIG. 13, an extended length of zipper closure 26 is provided via spool 70 simultaneously with the feeding of film 48. The "home" notches discussed above are punched into zipper closure 26 by an in-line punch incorporated in a slider applicator 72. Each notch is formed in the profile of zipper closure 26 before the zipper closure 26 is incorporated into the bag 10. Each of the slider devices 44 are provided from a rotating bowl 74 having a delivery conduit 76 which delivers a series of properly-oriented slider devices 44 to the applicator 72. The applicator 72 combines the zipper closure 26 with slider device 44 so that the slider device 44 is parked in the notch punched in the zipper closure 26. If misaligned on the zipper closure 26 or notch, the slider device 44 can be phased into register with the notch by sliding or moving the slider device 44 along zipper profile by guides or the like, until the slider device 44 is in register with the bag parked position or notch.

The elongated web 48 forming the tamper-evident header 46 is supplied from a roll 78. The header web 48 is delivered to a set of hole punches 80 and a set of perforators 82 to produce pairs of aligned openings 84 on opposite sides of three parallel, longitudinally extending, perforated or scored lines 86, 88, 90, which can best be seen in FIG. 3. The openings 84 are shown as being ovoid but may be of any shape and space desired. As will be appreciated hereafter, the openings 84 are strategically spaced according to the desired width of the bags 10 so that when the header 46 is attached to the bag 10, the openings 84 expose the slider device 44 at one end of the bag 10. Perforation or score line 86 is used to define an area of weakness for the tamper-evident membrane 60 on the lower end of header web 48 so as to permit rupture or breakage of the membrane 60. Perforation or score lines 88, 90 form respective areas of weakness on opposite sides of header web 48 to enable removal of header 46 from the side panels 12, 14 of the bag 10.

Figure 4:
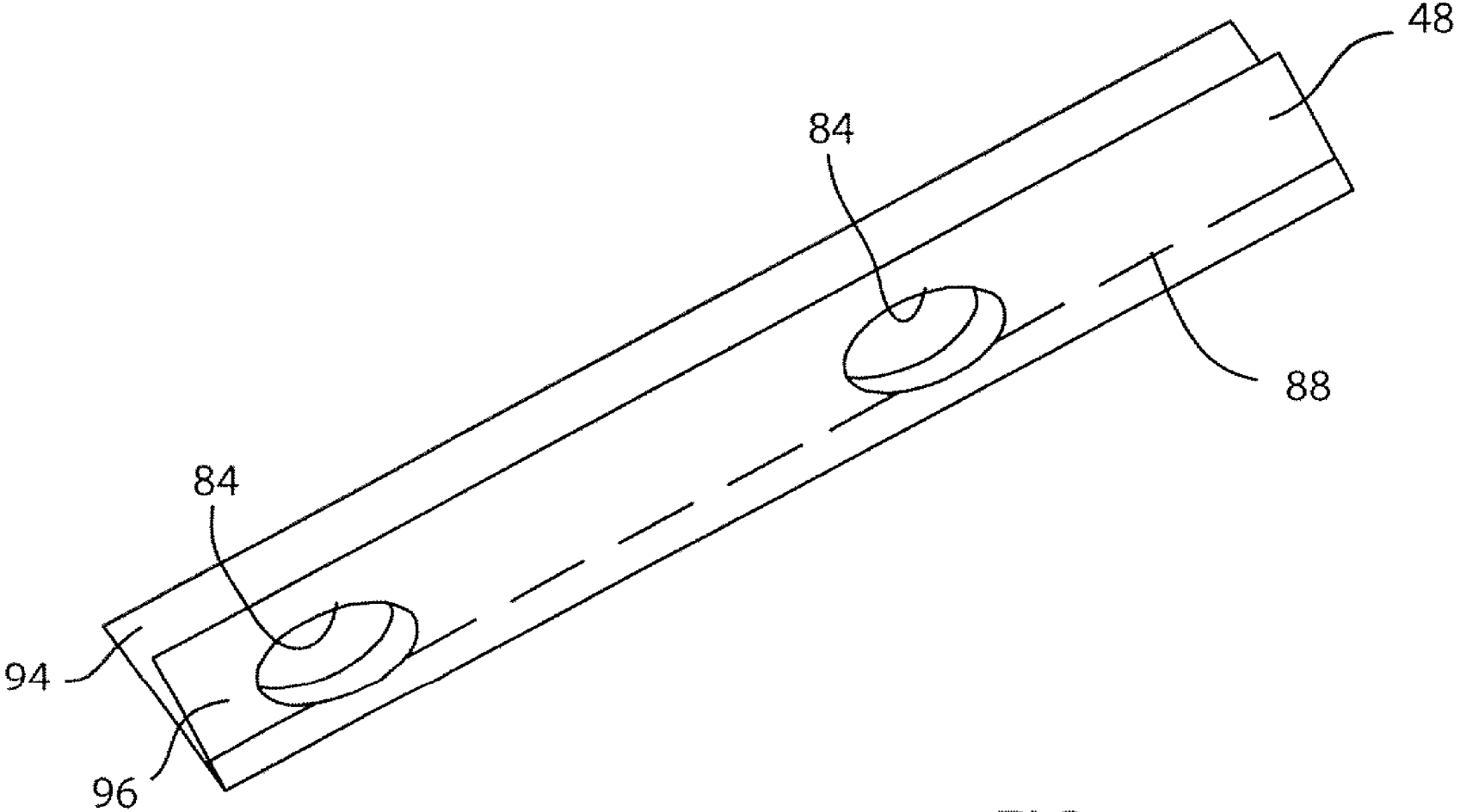
FIG. 4 is a perspective view of the tamper-evident header of FIG. 3 in a folded V-configuration.
Figure 6:
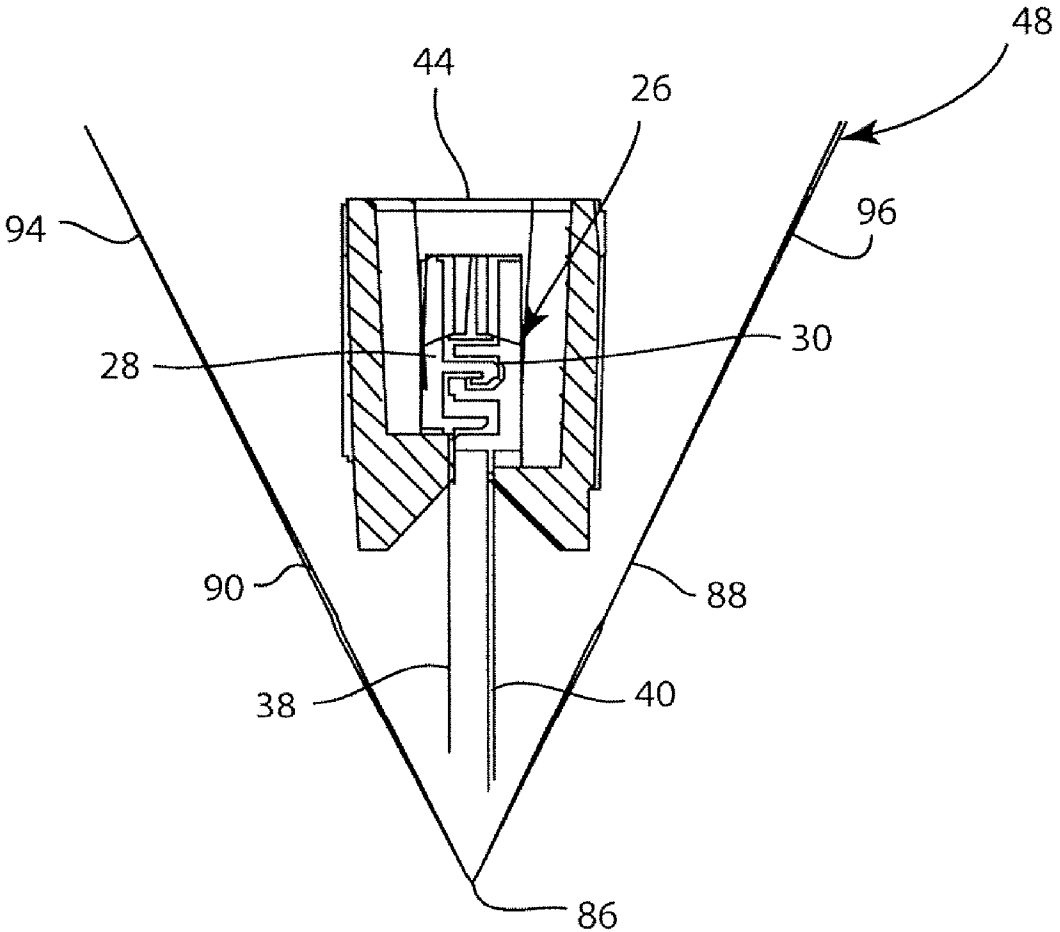
FIG. 6 is a schematic, end view of the combined zipper closure and slider device inserted in the folded tamper-evident header of FIG. 4.
Figure 7:
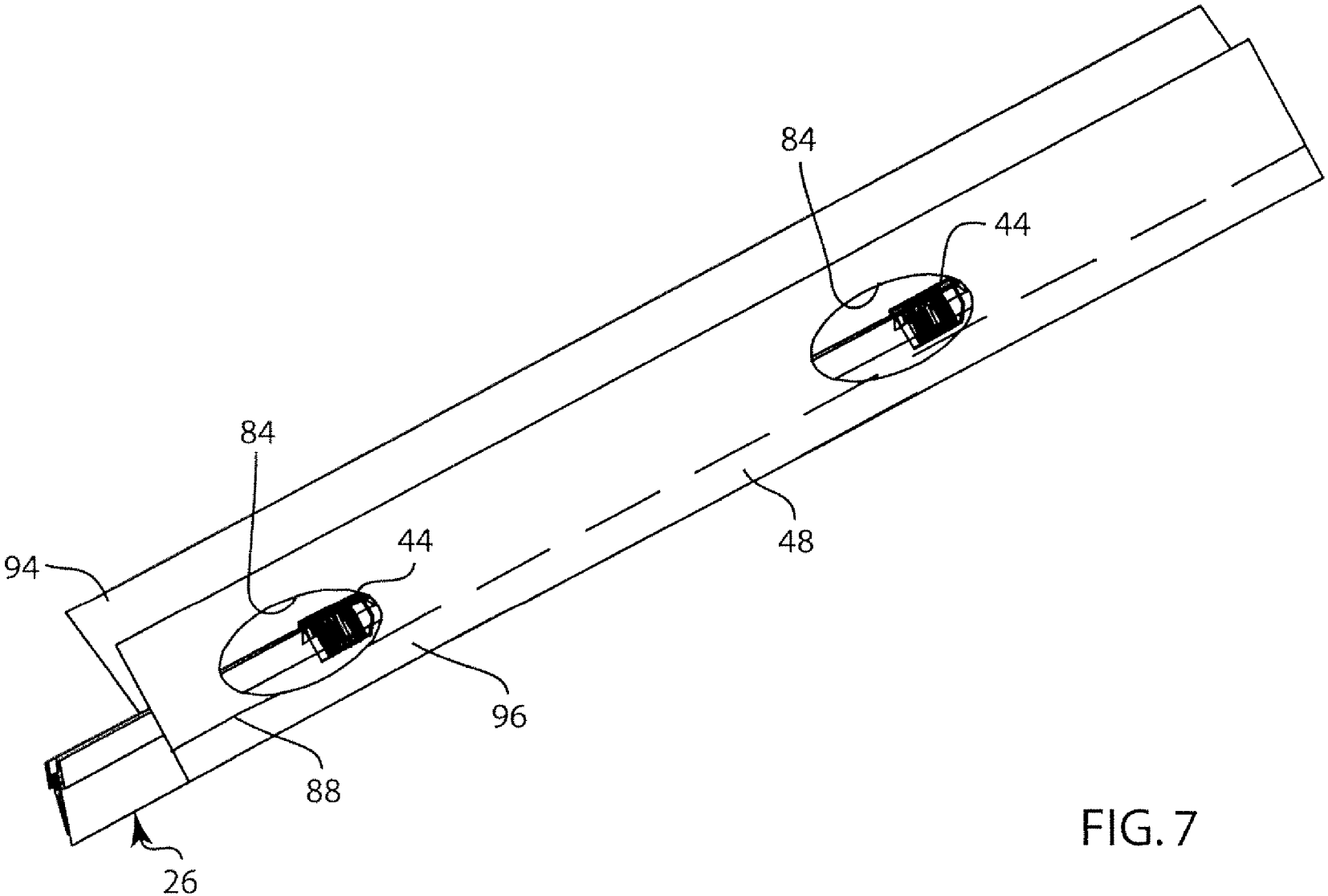
FIG. 7 is a perspective view of FIG. 6.

Referring back to FIG. 13, following the punching and perforating process, the header web 48 is transferred to a folding board 92 where it is folded in half into a V-configuration having connected sides 94, 96 as shown in FIG. 4. When folded, the openings 84 become aligned with one another. Perforation or score lines 86 run along the apex of the folded header web 48 and perforation or score lines 88, 90 run substantially parallel to each other along the bottom end of openings 84. As the folded header web 48 is advanced in the direction of arrow 98 (FIG. 13), the combined zipper closure 26 and the slider device 44 is driven around a vertical roller 100 and inserted into the folded header web 48 as depicted in FIG. 6. As also seen in FIG. 7, the placement or incorporation of the combined zipper closure 26 and slider device 44 in the folded header web 48 is such that the combined zipper closure 26 and slider device 44 is partially visible through openings 84.

Figure 8:
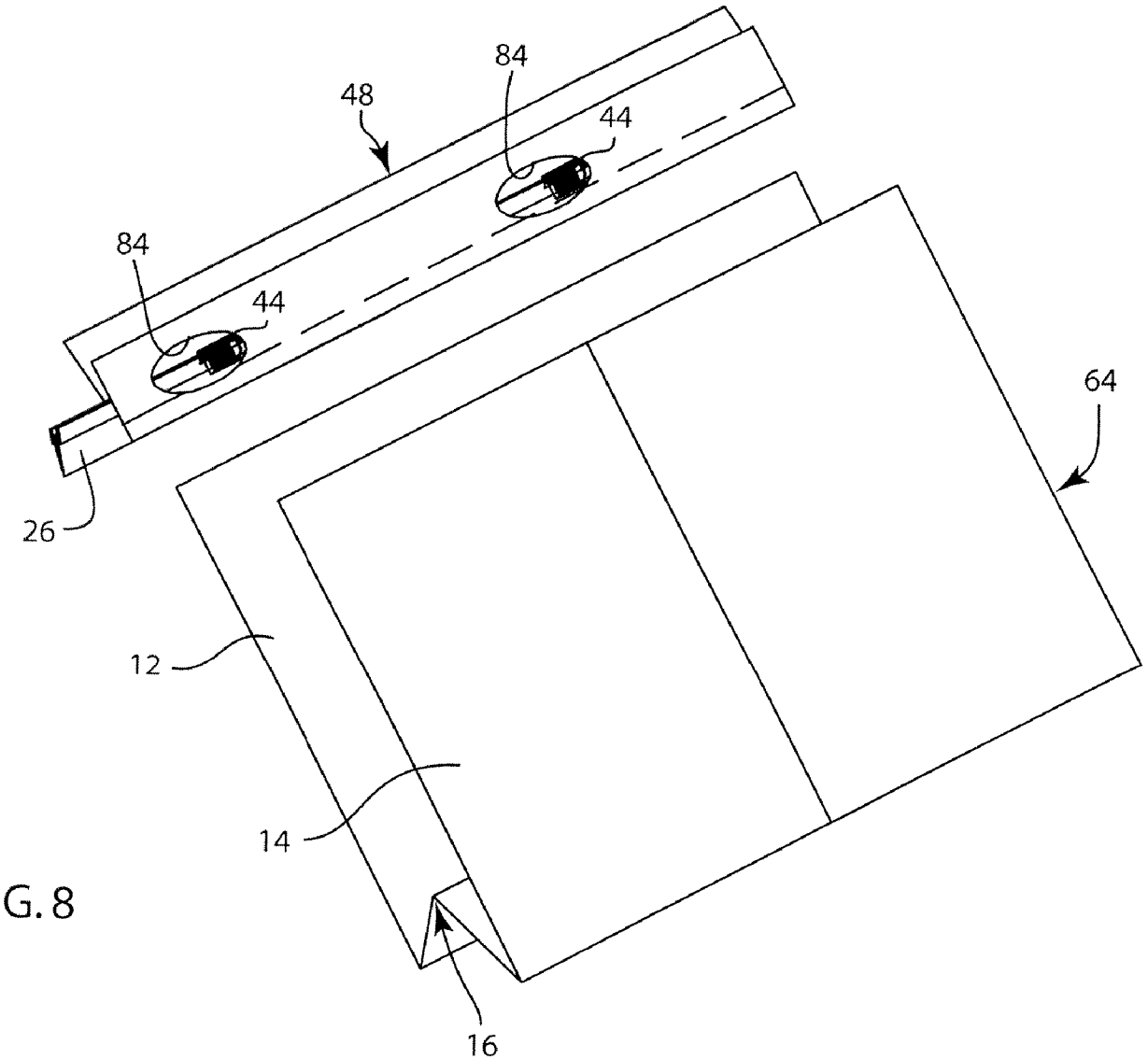
FIG. 8 is a schematic, perspective view of the folded tamper-evident header of FIG. 6 to be assembled to a side panel arrangement.

Referring back to FIG. 12, it can be seen that the folded web 48 with the combined zipper closure 26 and slider device 44 is directed through an upper portion of folding board 68 and along the upper portion of the folded film 64 or side panels 12, 14. Alternatively, the combined zipper closure and slider device can be fed around the folding board 68 and between the side panels 12, 14. For illustrative purposes, FIG. 8 portrays an exploded view of a segment of the folded header web 48 with the loosely positioned combined zipper closure 26 and slider device 44 removed from a segment of the folded side panel film 64 depicting two bags.

Figure 11:
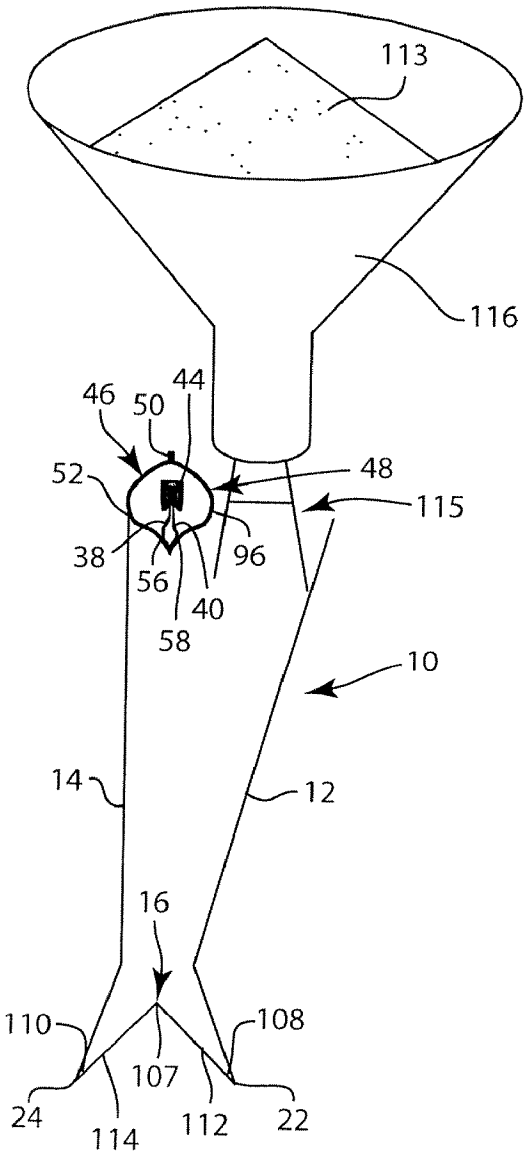
FIG. 11 is a schematic, end view of FIG. 10.

As shown in FIG. 12, a top seal bar 101, positioned at the top of the process line, seals the flanges 38, 40 of the zipper closure 26 to the folded header web 48. The resulting tamper-evident structure 46 provides an indication to the consumer whether bag 10 has been previously opened. In order to gain access to the interior bag 10, the tamper-evident header 46 and its tamper-evident membrane 60 needs to be penetrated such as by cutting and/or removing. Top seal bar 101 has sealing surfaces positioned to provide pressure and typically heat to the area where the bottom ends of the flanges 38, 40 of zipper closure 26 meet the lower portion of the folded header web 48 or membrane 60 to form seals 56, 58 (FIGS. 2, 11). The top seal bar 102 has surfaces positioned to provide pressure and to typically heat an area above slider device 44 in FIG. 11, and form a seal between the upper ends of folded header web 48 at a topmost, horizontal seal 50. In addition, the top seal bar 102 has a second surface for sealing one side or midportion only of the folded header web 48 at 52 to the top of one side panel, shown in FIG. 11 as side panel 14.

Figure 9:
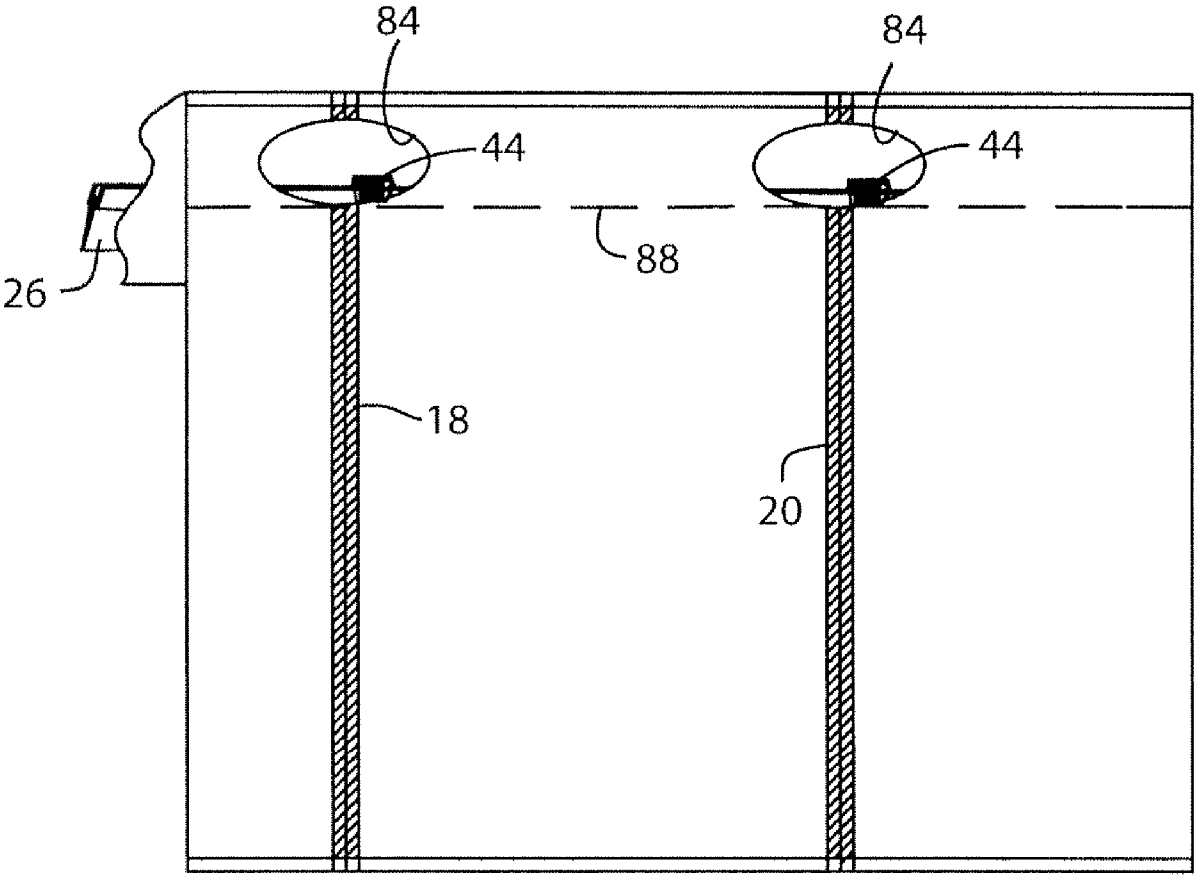
FIG. 9 is a schematic, front view of the partial assembly of FIG. 8.

After the sealing of the header web 48, heated seal bars 104 shown in FIG. 12 provide vertical side seals on the film and tamper-evident header combination. These vertical seals will eventually result in side seams 18, 20 of package or bag 10 in FIG. 1. Side seams 18, 20 extend along the substantially entire height of bag 10 except for the portions interrupted by header openings 84 as appreciated in FIG. 9. Typically, each seal bar 104 has a pair of bars on opposite sides of the film. Heat may be provided on one or both sides.

As shown in FIG. 12, a bottom seal bar 106 located on the bottom of machine 62 is used to heat seal the bottom of bag 10 and provide a seal 107 between folded legs 112, 114 of the bottom wall 16 as depicted in FIG. 11. Folds 108, 110 extend across the entire length of the bottom edges 22, 24 from side seam 18 to side seam 20.

Figure 10:
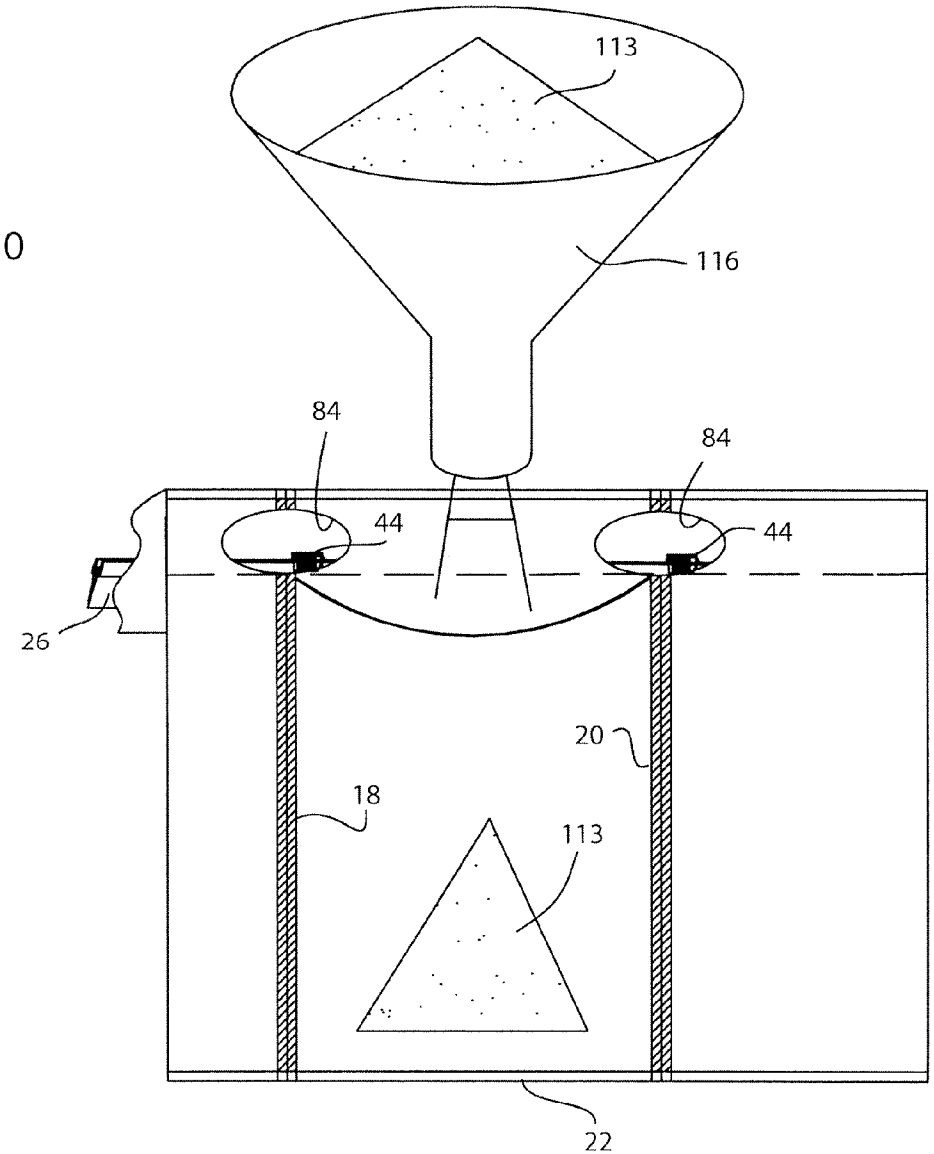
FIG. 10 is a schematic, front view of the package of FIG. 9 being top-filled.

FIGS. 10 and 11 represent views of the bag formation process after the bottom folds 108, 110 have been made, and the bag being formed arrives at a filling station 115 (FIG. 12) downstream of seal bar 106. At the filling station 115 shown in FIG. 11, items or materials 113 (e.g. cereal, snack food, fertilizer, etc.) to be contained in the resulting package 10 are delivered by hopper 116. Hopper 116 includes valves, gates and doors, as needed, to deposit an appropriate amount of item 113 into the package 10 from the top thereof through a filling opening 115 between the unconnected side 96 of the header web 48 and the side panel 12. It should now be appreciated that at the point of filling (FIG. 11), the header web 48 protectively surrounds the combined zipper closure 26 and slider device 44 so that particles of the fill material 113 are prevented from entering and contaminating the profiles 28, 30 of the zipper closure 26.

Subsequent to the filling operation, a sealing bar 118 at the top of machine 62 is used to connect the unconnected side 96 of the header web 48 to the top of side panel 12 at horizontal seal 54 as shown in FIG. 1. Preferably, the perforations 88, 90 or other weakened area are positioned close to the area where the midportions of header web 48 are sealed to the side panels 12, 14. This is done to minimize the amount of film remaining close to the slider device 44 after the tamper-evident header 46 is removed from bag 10 as illustrated in FIG. 14.

As shown in FIG. 12, a vertically oriented blade or cutter bar 120 cuts the edges at the side seams 18, 20 to provide individual, filled, free standing packages 122.

Figure 17:
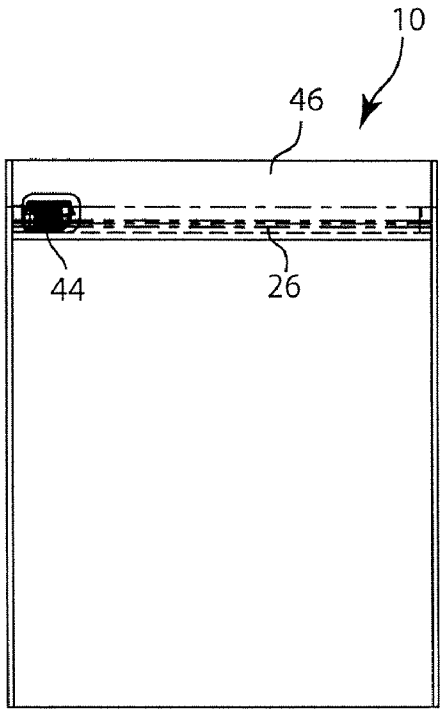
FIGS. 15, 16 and 17 are front views of alternative finished packages capable of being formed from the present invention.
Figure 16:
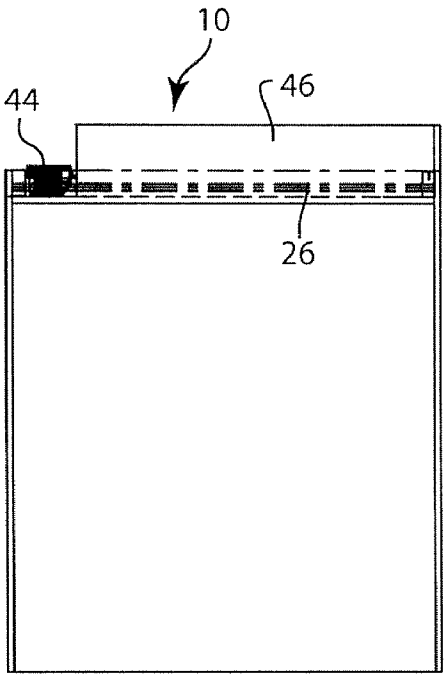
Figure 15:
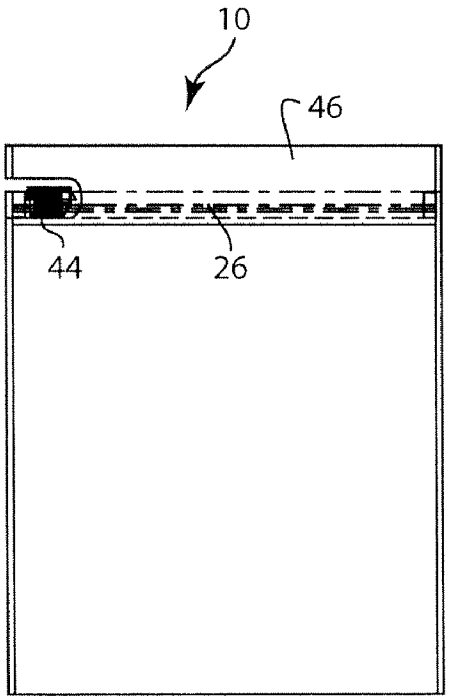

The resulting finished bag 10 is shown in FIGS. 1 and 2. In the preferred embodiment, the header 46 is constructed such that both ends of zipper closure 26 as well as slider device 44 are exposed. However, the invention contemplates other header configurations such as shown in FIGS. 15-17 in which only one end of the zipper closure 26 and the slider device 44 are exposed. In each design, the header 46 is removable along perforation lines 86, 88 to produce the bag 10 shown in FIG. 14. To gain full access to the interior of the bag 10, the tamper-evident membrane 60 is broken along perforation line 86 (FIG. 2).

It should now be appreciated that process machine 62 provides a flexible, reclosable stand-up bag 10 with a removable, external tamper-evident header 46, as well as a breakable, internal tamper-proof membrane 60 as seen in FIGS. 1 and 2. The provision of header web 48 in the manufacture of a flexible bag 10 as set forth above prevents contaminating the zipper profiles 28, 30 during filling of the bag 10 and provides tamper-proof structure which maintains the freshness of a product over a long period of time.

Having described the presently preferred embodiments, it is to be understood that the invention may be otherwise embodied within the scope of the appended claims.

What is claimed is:

1. A method of manufacturing a reclosable, tamper-evident package filled with a product, the method comprising the steps of:

providing a continuous strip of a tamper-evident header, the tamper-evident header including a first side, a second side and a zipper closure having a first closure profile sealed to the first side and a second closure profile sealed to the second side, the header defining at least one void for exposing one end of the zipper closure;

inserting the tamper-evident header between a first film panel and a second film panel;

sealing the first side of the tamper-evident header to the first film panel;

filling the package with product, the product passing between the second side of the tamper-evident header and the second film panel; and sealing the second side of the tamper-evident header to the second film panel.

2. The method of claim 1 wherein the header includes at least two areas of weakness that enable removal of portions of the tamper-evident header after the tamper-evident header has been attached to both the first film panel and the second film panel.

3. A method of manufacturing a reclosable, tamper-evident package filled with a product, the method comprising the steps of:

providing a continuous strip of a tamper-evident header, the tamper-evident header including a first side, a second side and a zipper closure having a first closure profile sealed to the first side and a second closure profile sealed to the second side;

inserting the tamper-evident header between a first film panel and a second film panel;

sealing the first side of the tamper-evident header to the first film panel;

filling the package with product, the product passing between the second side of the tamper-evident header and the second film panel; and sealing the second side of the tamper-evident header to the second film panel;

wherein the first side and the second side of the tamper-evident header are joined to each other alone a fold line and sealed to each other to enclose the zipper closure between the first side and the second side of the tamper-evident header.

4. The method of claim 3 wherein the header includes at least two areas of weakness that enable removal of portions of the tamper-evident header after the tamper-evident header has been attached to both the first film panel and the second film panel.

5. The method of claim 3 wherein the header is provided with at least one void for exposing one end of the zipper closure.

6. A method of manufacturing and filling a reclosable, tamper-proof package, the method comprising the steps of:

supplying a web of plastic material folded to define first and second opposing side panels joined by a bottom wall;

providing a tamper-evident header in the form of a header web having opposite sides;

inserting a combined zipper closure and slider device between the opposite sides of the header web;

sealing each of the opposite sides of the header web to the zipper closure so that the header web extends above the combined zipper closure and the slider device;

sealing opposite sides of the header web extending above the combined zipper closure and slider device to one another;

sealing one side of the header web to one of the first and second side panels;

sealing the first and second opposing side panels to each other along a pair of spaced side seals to define a package having an open package interior;

filling the package with a product, the product passing between the other side of the header web and the other of the first and second side panels; and sealing the other side of the header web to the other of the first and second side panels after the package has been filled with product.

7. The method of claim 6 wherein the step of providing a tamper-evident header includes the step of folding the header web.

8. The method of claim 6 wherein the zipper closure includes first and second profile members each including a depending attachment flange, and the attachment flanges are joined to the header web at first and second seals.

9. The method of claim 8 wherein the header web includes perforation lines, including a first perforation line that defines an area of weakness extending between the first and second seals.

10. The method of claim 9 wherein a top of the first side panel is connected to one midportion of the header web at a third seal, and the top of the second side panel is attached to another midportion of the header web at a fourth seal.

11. The method of claim 10 wherein a second perforation line defines an area of weakness located above the third seal.

12. The method of claim 11 wherein a third perforation line defines an area of weakness located above the fourth seal.

13. The method of claim 6 wherein, following the step of sealing the other side of the header web to the other of the first and second side panels, the header web exposes opposite sides of the combined zipper closure and slider device.

14. A method of manufacturing and filling a reclosable, tamper-proof package, the method comprising the steps of:

supplying a web of plastic material folded to define first and second opposing side panels joined by a bottom wall;

providing a tamper-evident header in the form of a header web having opposite sides, including forming the header web with a series of parallel, spaced apart, longitudinal perforation lines and forming the header web with a plurality of aligned openings located on opposite sides of the perforation lines;

inserting a combined zipper closure and slider device between the opposite sides of the header web;

sealing each of the opposite sides of the header web to the zipper closure so that the header web extends above the combined zipper closure and the slider device and is connected to the zipper closure;

sealing one side of the header web to one of the first and second side panels;

sealing the first and second opposing side panels to each other along a pair of spaced side seals to define a package having an open package interior;

filling the package with a product, the product passing between the other side of the header web and the other of the first and second side panels; and sealing the other side of the header web to the other of the first and second side panels after the package has been filled with product.

15. The method of claim 14 wherein the step of providing a tamper-evident header includes the step of folding the header web.

16. The method of claim 14 wherein the zipper closure includes first and second profile members each including a depending attachment flange, and the attachment flanges are joined to the header web at first and second seals.

17. The method of claim 16 wherein a first perforation line defines an area of weakness in the header web extending between the first and second seals.

18. The method of claim 14 wherein a top of the first side panel is connected to one midportion of the header web at a third seal, and the top of the second side panel is attached to another midportion of the header web at a fourth seal.

19. The method of claim 18 wherein a second perforation line defines an area of weakness located above the third seal.

20. The method of claim 18 wherein a third perforation line defines an area of weakness located above the fourth seal.

21. The method of claim 14 wherein the opposite sides of the header web extending above the combined zipper closure and slider device are secured at a fifth seal.

22. The method of claim 14 wherein, following the step of sealing the other side of the header web to the other of the first and second side panels, the header web exposes opposite sides of the combined zipper closure and slider device.

23. A method of manufacturing a fillable, reclosable, tamper-evident package comprising the steps of:

providing a tamper-evident header in the form of a header web having opposite sides;

inserting a combined zipper closure and slider device between the opposite sides of the header web; and incorporating the header web with the combined zipper closure and slider device between first and second film panels joined by a bottom wall;

wherein the header web is provide with at least one void for exposing one end of the combined zipper closure and slider device.

24. The method of claim 23 wherein the step of incorporating the header web with the combined zipper closure and slider device between the first and second film panels comprises sealing each of the opposite sides of the header web to the zipper closure;

sealing one side of the header web to one of the first and second film panels;

sealing the first and second film panels to each other along a pair of spaced side seals to define a package having an open package interior;

filling the package with a product, the product passing between the other side of the header web and the other of the first and second film panels; and sealing the other side of the header web to the other of the first and second film panels after the package has been filled with product.

25. The method of claim 23 wherein the step of providing a tamper-evident header includes punching the at least one void in the header web;

perforating the header web; and folding the header web.

* * * * *